US005685034A

United States Patent [19]

Kleer et al.

[11] Patent Number: 5,685,034

[45] Date of Patent: Nov. 11, 1997

[54] HOSPITAL BED WITH INTEGRATED TOILET FACILITY

[76] Inventors: Johannes-Konrad Kleer, Richard-Wagner-Strasse 90, 66125 Saarbrücken; Joachim König, In den Kreuzlängten 12, 66352 Grossrosseln; Michael Hehl, Pasteurschacht 19, 66113 Saarbrücken; Peter Geiss, An der Friedens-eiche 12, 66352 Grossrosseln, all of Germany

[21] Appl. No.: 606,595

[22] Filed: Feb. 26, 1996

[30] Foreign Application Priority Data

Feb. 27, 1995 [DE] Germany ..... 195 06 726.6

[51] Int. Cl.[6] ..... A61G 7/00

[52] U.S. Cl. ..... 5/604; 5/617; 5/618

[58] Field of Search ..... 5/604, 605, 617, 5/618

[56] References Cited

U.S. PATENT DOCUMENTS

| | | | |
|---|---|---|---|
| 972,100 | 10/1910 | Grandall . | |
| 1,636,705 | 7/1927 | Prettenthaler . | |
| 2,678,452 | 5/1954 | Beem . | |
| 2,689,354 | 9/1954 | Sullivan | 5/604 X |
| 2,755,488 | 7/1956 | Fuhrer | 5/618 |
| 2,779,951 | 2/1957 | Travis | 5/618 X |
| 2,956,289 | 10/1960 | Sullivan | 5/617 |
| 4,258,445 | 3/1981 | Zur | 5/604 X |
| 4,847,929 | 7/1989 | Pupovic . | |

FOREIGN PATENT DOCUMENTS

| | | |
|---|---|---|
| 558 077 A1 | 9/1993 | European Pat. Off. . |
| 473 580 | 7/1969 | Switzerland . |
| WO 95/045 13 | 2/1995 | WIPO . |

*Primary Examiner*—Michael F. Trettel
*Attorney, Agent, or Firm*—Henry M. Feiereisen

[57] ABSTRACT

A hospital bed includes a frame assembly having a two-part mattress support comprised of a head mattress support and a foot mattress support, with the head mattress support including a head portion and a horizontal ramp articulated to one another, and with the foot mattress support including an front portion and a rear portion articulated to one another. The head mattress support is movable in a horizontal direction relative to the foot mattress support and tiltable in a vertical direction while the front portion of the foot mattress support is tiltable in a vertical direction, with the rear portion of the foot matress support movable between outer and inner positions to allow formation of an opening when the rear portion of the foot mattress support is moved to inner position. An upwardly open toilet pan which is supported by the frame assembly is movable in position for vertical registry with the opening when the rear portion of the foot mattress support occupies the inner position.

14 Claims, 2 Drawing Sheets

HOSPITAL BED WITH INTEGRATED TOILET FACILITY

BACKGROUND OF THE INVENTION

The present invention refers to a hospital bed with integrated toilet facility, and in particular to a hospital bed of a type having a frame assembly with a mattress support for carrying a mattress, and a toilet pan positioned centrally of the hospital bed underneath the frame assembly.

European patent specification 05 58 077 discloses a hospital bed with a frame assembly in form of a head base and a foot base which are separated from each other, and with a stationary toilet pan underneath the frame assembly at a level of the point of abutment between the head base and the foot base. The head base is comprised of a front portion and a rear portion which are hingedly connected to each other so that the front portion can be tilted up relative to the rear portion. In addition, the rear portion can be moved forwards and backwards together with the front portion. The foot base is also comprised of a front portion and a rear portion hingedly connected to each other and capable of being tilted up and down about the pivot.

In the bed state of the hospital bed, the head base and the foot base abut each other and form together a support area for the patient. If the patient wishes to use the toilet facility, the head base is moved in direction of the head board while the front portion of the foot base is tilted upwards about the hinge that connects the front portion and the rear portion of the foot base. As the front portion of the foot base is tilted up, a flexible sheet made of synthetic material which has a width corresponding to the width of the hospital bed and is secured with its forward end to the forward edge of the front portion of the foot base, is rolled off from a roller and drawn slantingly from bottom to top over the opening formed between the rear portion of the head base and the front portion of the foot base. The sheet closes the opening for use of the stationary toilet pan. After use of the toilet facility, the front portion of the foot base is lowered, the flexible sheet is rolled onto the roller, and subsequently, the head base and the foot base are moved together for providing bed support for the patient.

This conventional hospital bed has the drawback that during elevation and lowering of the front portion of the foot base, the forward edge of the foot base and the flexible sheet that forms the toilet seat slide along the buttock and underside of the patient's thigh so that already irritated or sore skin of the patient becomes even further irritated. For patients which are unable to raise their lower body and their legs by their own force, assistance must be provided to avoid such friction at the critical body parts during us e of the toilet facility.

SUMMARY OF THE INVENTION

It is an object of the present invention to provide an improved hospital bed with integrated toilet facility, obviating the afore stated drawbacks.

In particular, it is an object of the present invention to provide an improved hospital bed that allows a patient to use the toilet facility in seated position without any assistance from others and without experiencing any relative movements between body parts of the patient and portions of the hospital bed that cause friction and irritation of the skin.

These objects and others which will become apparent hereinafter are attained in accordance with the present invention by providing the frame assembly in form of a two-part mattress support which is quadruply sectioned by having a head mattress support including a head portion and a horizontal ramp hingedly connected to one another, and a foot mattress support including a front portion and a rear portion swingably mounted to one another, with the head mattress support being movable in a horizontal direction and the head portion thereof being upwardly tiltable, and with the front portion of the foot mattress support being tiltable upwardly, and the rear portion thereof being moveable between outer and inner positions to allow formation of an opening when the rear portion of the foot mattress support is moved to the inner position, whereby the opening exhibits a size defined by the adjustment of the head mattress support in horizontal direction relative to the foot mattress support, and cooperates with a toilet pan which is supported by the frame assembly and movable in position for vertical registry with the opening when the rear portion of the foot mattress support occupies the inner position.

As all drive mechanisms for executing the various movements of the individual parts of the frame assembly of the hospital bed are controllable by suitably placed buttons that are conveniently within reach of the patient, the patient is able to use the toilet pan in anatomically proper posture because the toilet pan is moved in direction of the buttock of the patient so that relative movements between body parts and components of the hospital bed are eliminated. The comfort level for the patient is thus significantly enhanced. The drive mechanisms for effecting the turning and rolling motions may be operated electrically, hydraulically or pneumatically.

Suitably, the ramp of the head mattress support is formed with rollers to guide the head mattress support during displacement in horizontal direction. The actuation of the front portion of the foot mattress support is effected by a T-frame comprised of a horizontal section which is secured to the hinge between the front portion and the rear portion of the foot mattress support, a vertical section positioned at the head-distant end of the front portion and formed with rollers, and a drive mechanism moving the vertical section upwardly to thereby tilt the foot mattress support. A rocker is further linked to the T-frame and operated by a drive mechanism for moving the rear portion of the foot mattress support between the inner and outer positions According to another feature of the present invention, the frame assembly can be turned about a pivot positioned underneath the head mattress support to enable a swinging of the entire hospital bed in a low position for the head portion.

Suitably, the two-part mattress support is provided in form of a split slat frame, with respective mattresses laying atop the slat frames.

The frame assembly of the hospital bed according to the present invention may be placed upon a stationary bed stand or upon a mobile bed stand. Suitably, the toilet pan may be provided with a drain for discharge of excretions, and may also have incorporated therein a cleaning unit for cleansing and disinfecting the toilet facility after use. In addition, a lid may be secured to the frame assembly to sealingly close off the toilet pan when being in idle position.

The hospital bed according to the present invention represents a fully functional bed that allows adjustment to various positions while at the same time affording an anatomically proper posture for the patient for automatic use of the toilet facility without requiring the patient to leave the bed or to request assistance. It is of particular advantage, that the patient is able to make the necessary adjustments of the hospital bed and to use the toilet pan without experiencing any friction that may cause skin irritation and uncomfort for the patient.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
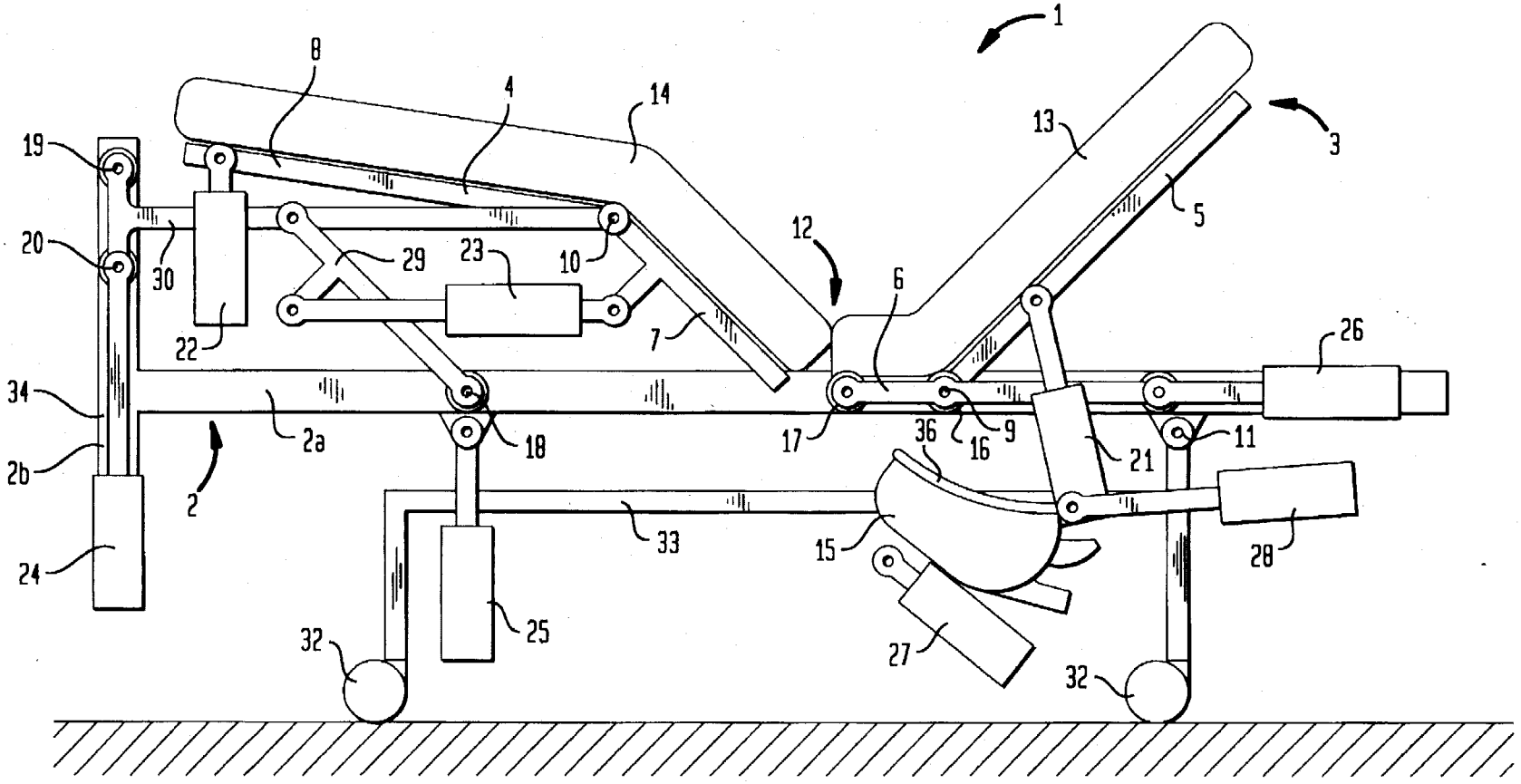
FIG. 1 is a schematic side elevational view of one embodiment of a hospital bed according to the present invention, showing a normal bed state with elevated foot mattress support and head mattress support.

Throughout all the Figures, the same or corresponding elements are always indicated by the same reference numerals.

Turning now to the drawing, and in particular to FIG. 1, there is shown a schematic side elevational view of one embodiment of a hospital bed according to the present invention, generally designated by reference numeral 1 and depicted in a normal bed state. In the nonlimiting example of FIG. 1, the hospital bed 1 is placed upon a bed stand 33 which is of mobile configuration via rollers 32. Supported by the bed stand 33 is a T-shaped frame assembly, generally designated by reference numeral 2 and including a horizontal frame section 2*a* and a transverse frame section 2*b* secured on one end of the frame section 2*a*.

Placed upon the frame assembly 2 is a split or two-part mattress support in form of e.g. a split slat frame, comprised of a head mattress support 3 and a foot mattress support 4. The head mattress support 3 is of two-part configuration and includes a head portion 5 and a horizontal ramp 6 rotatably secured to one another via a hinge 9. The ramp 6 is supported by rollers 16, 17 which are guided for displacement in horizontal direction in the track-forming frame section 2*a*. The foot mattress support 4 is also of two-part configuration and includes a rear portion 7 for support of the patient's thighs and a front portion 8 for support of the lower leg and foot parts of the patient. The front and rear portions of the foot mattress support 4 are rotatably secured to one another via a hinge 10 so as to allow formation of a bend for support of the patient's knee.

Laid atop the head mattress support 3 is a mattress 13, and laid atop the foot mattress support 4 is a mattress 14. Both mattresses 13, 14 are secured in a non-skid manner upon the respective mattress supports 3, 4.

The head portion 5 of the mattress support 3 is upwardly tiltable by a drive element 21 to rotate about the hinge 9 with respect to the frame assembly 2. The drive element 21 is secured with one end to the bed stand 33 and mounted with its other end to the head portion 5. In the area of the horizontal ramp 6, the mattress 13 assumes a configuration in form of a seat that supports the buttock of the patient. Supported on the frame section 2*a* at its end distant to the frame section 2*b* is a further drive element 26 for moving the head mattress support 3 horizontally within the track-forming frame section 2*a* via the rollers 16, 17. The frame section 2*b* of the frame assembly 2 is also formed with a track to receive the vertical section 34 of a T frame, generally designated by reference numeral 30. The vertical section 34 includes a pair of rollers 19, 20 for movement within the track of frame section 2*b* in vertical direction to upwardly tilt the front portion 8 of the foot mattress support 4. Swingably secured at a suitable point to the horizontal section of the T-shaped frame 30 is one end of a rocker 29. The other end of the rocker 29 is formed with a roller 18 for rolling motion within the track of frame section 2*a* so that an adjustment of the T frame 30 by means of the drive element 24 causes a displacement of the rocker 29 via the roller 18 in horizontal direction. The rocker 29 is further acted upon by a drive element 23 which extends between the rear portion 7 of the foot mattress support 4 and the rocker 29 and is provided to move the rear portion 7 between inner and outer positions.

A drive element 22 is provided to act upon the head-distant end of the front portion 8 to allow an upward tilting of the front portion 8 alone, without adjustment of the rear portion 7. The adjustment of the foot mattress support 4 to form the knee bend in the bed state, as shown in FIG. 1, is effected by raising the front portion 8 through operation of the drive element 24 and by actuation of the drive element 23 which acts between the rocker 29 and the rear portion 7 to move the rear portion 7 into the outer slanted position.

As further shown in FIG. 1, the entire hospital bed 1 can be swung about pivot 9 through actuation of a drive element 25 for positioning the head support in a low position. The drive element 25 is secured to the underside of the frame section 2*a* in the area of the foot mattress support 4 to swing the frame assembly 2 about a pivot 11 formed underneath the head portion 5 so that the foot end of the frame assembly 2 is elevated and the head end is lowered in a manner resembling a beam balance. The low head position of the head portion 5 can be varied through selective combinations of the drive elements 21, 25.

Situated underneath the frame section 2*a* is a toilet pan 15 which is movably secured via a cam and roller mechanism through operation of a drive element 27. A lid 36 is acted upon by a drive element 28 for sealing the toilet pan 15 in the bed state of the hospital bed 1, as shown in FIG. 1. In the bed state of the hospital bed 1, the foot mattress support 4 and the head mattress support 3 are moved together to form a proper bed for the patient.

Figure 2:
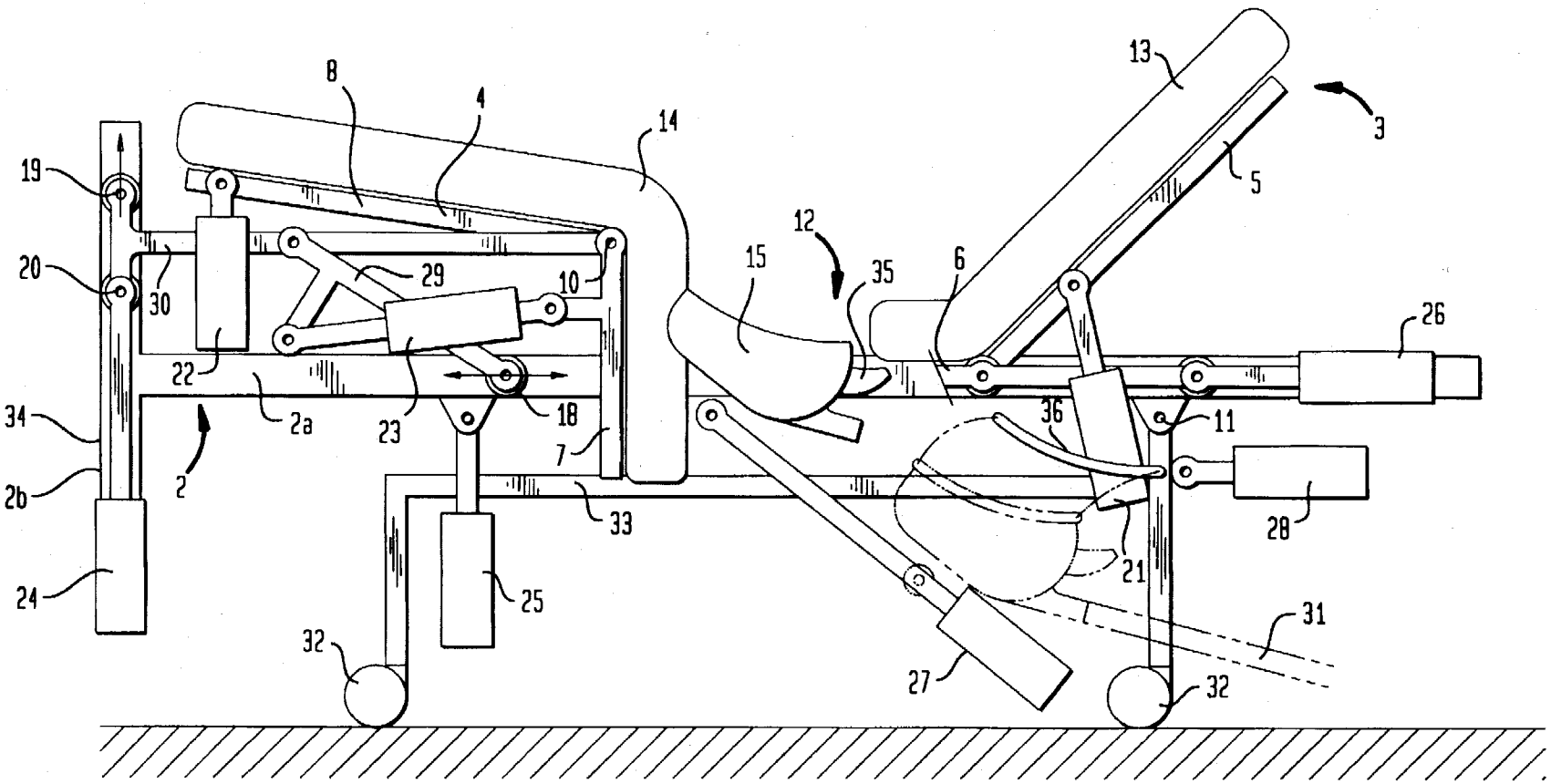
FIG. 2 is a schematic side elevational view of hospital bed of FIG. 1, showing the hospital bed in a position for use of a toilet facility, with the foot mattress support and head mattress support moved apart.

Turning now to FIG. 2, there is shown a schematic side elevational view of the hospital bed 1 in a position suitable for use of the toilet pan 15. In order to form a bed opening 12, the rear portion 7 of the foot mattress support 4 is moved inwardly by the drive element 23 and the rocker 29. The size of the opening 12 can be selected by suitably moving the head mattress support 3 through actuation of the drive element 26 in relation to the foot mattress support 4. In this manner, the opening 12 can be adjusted in an optimum manner with respect to the toilet pan 15. Subsequently, drive element 27 is operated to move the toilet pan 15 away from the lid 36 into vertical registry with the bed opening 12 and to press it against the mattress 14 of the rear portion 7. The opening 12 is positioned in the area of the patient's thigh, with the weight of the patient being securely supported by the head portion 5, the ramp 6 and the front portion 8. In order to reinforce the head mattress support 3 during use of the toilet facility, the toilet pan 15 is formed with a slanted rear plate 35 which travels under the ramp 6. An unintentional formation of the opening 12 is prevented by drive element 26.

In the bed state of the hospital bed 1, as shown in FIG. 1, the toilet pan 15 occupies a substantially horizontal position underneath the head portion 5 and is sealed off by the lid 36 through force exerted by the drive element 28. After positioning the toilet pan 15 in vertical registry with the opening 12, the seated position of the patient can be best suited to individual needs through proper operation of the drive elements 21, 22, 23, 24, 25, 26.

It will be appreciated by person skilled in the art that the hospital bed 1 according to the present invention must contain additional components which do not appear in the foregoing Figures. For example, the hospital bed 1 includes a control mechanism with various buttons to allow actuation of the drive elements 21 to 28 which may be operated electrically, hydraulically or pneumatically. Also, all the movable parts may be equipped with "fail-safe" brakes which apply in the event of power failure and which positively prevent motion unless released, and limit switches, position centers etc. may be necessary to prevent damage to the apparatus or injury to the patient in the event of improper operation or equipment malfunction. However, these components, like much other necessary components are not part of the invention and have been omitted from the Figures for the sake of simplicity.

After use of the toilet facility, the toilet pan 15 with received excretions and toilet paper is withdrawn and moved to the retracted position by the drive element 27 and sealed off by the lid 36 through actuation of the drive element 28. The opening 12 between the split mattress supports 3,4 is closed through lowering of the front portion 8, upward tilting of the rear portion 7 and displacement of the ramp 6 in direction towards the foot mattress support 4. Individual laying positions can then selected by the patient in any desired manner through actuation of the various drive elements.

As further shown in FIG. 2, the toilet pan 15 may have incorporated therein a drain 31 for discharge of the excretions and toilet paper dropped in the toilet pan 15. Installed in the drain 31 may be a chopper and a waste water pump which however are not shown in the foregoing Figures for sake of simplicity. Moreover, a high pressure suction device and possibly a drying mechanism may be incorporated in the toilet lid 36, and an air suction ventilator and a disinfecting device may be installed in the toilet facility, if desired. Thus, after being sealed by the lid 36, the toilet pan 15 can be cleaned by high pressure jets. Dirty water is withdrawn by the chopper and the waste water pump, and in a second cleaning stage, the toilet pan 15 is disinfected and subsequently dried.

While the invention has been illustrated and described as embodied in a hospital bed with integrated toilet facility, it is not intended to be limited to the details shown since various modifications and structural changes may be made without departing in any way from the spirit of the present invention.

What is claimed as new and desired to be protected by Letters Patent is set forth in the appended claims:

We claim:

1. A hospital bed, comprising:

a frame assembly including a two-part mattress support comprised of a head mattress support and a foot mattress support, with the head mattress support including a head portion and a horizontal ramp articulated to one another, and with the foot mattress support including an front portion and a rear portion articulated to one another;

a first drive mechanism for moving the head mattress support in a horizontal direction and tilting the head mattress support;

a second drive mechanism for tilting the front portion of the foot mattress support and moving the rear portion of the foot mattress support between outer and inner positions to allow formation of an opening when the rear portion of the foot mattress support is moved to the inner position whereby the opening exhibits a size that is defined by the adjustment of the head mattress support in horizontal direction relative to the foot mattress support; and an upwardly open toilet pan supported by the frame assembly and movable in position for vertical registry with the opening when the rear portion of the foot mattress support occupies the inner position.

2. The hospital bed of claim 1, and further comprising a mattress laying atop the head mattress support and a mattress laying atop the foot mattress support.

3. The hospital bed of claim 1 wherein the ramp of the head mattress support is formed with rollers for guiding the head mattress support horizontally along the frame assembly.

4. The hospital bed of claim 1 wherein the second drive mechanism includes a T frame having a horizontal section swingably mounted to the foot mattress support and a vertical section provided with rollers that run in a vertical track formed by the frame assembly, and a drive element acting on the vertical section to move the rollers in a vertical direction.

5. The hospital bed of claim 4 wherein the foot mattress support includes a rocker having one end pivoted to the horizontal section of the T frame and another end in the form of a roller that moves in a horizontal direction and supports the foot mattress support during actuation of the drive element.

6. The hospital bed of claim 5 wherein the second drive mechanism includes a further drive element connecting the rear portion of the foot mattress support with the rocker to move the rear portion between the inner and outer positions.

7. The hospital bed of claim 1, and further comprising a third drive mechanism acting on the frame assembly for turning the frame assembly about a pivot positioned underneath the head portion of the head mattress support.

8. The hospital bed of claim 1 wherein the two-part mattress support is a split slat frame.

9. The hospital bed of claim 7 wherein the first, second and third drive mechanism are electrically operated.

10. The hospital bed of claim 7 wherein the first, second and third drive mechanism are hydraulically operated.

11. The hospital bed of claim 7 wherein the first, second and third drive mechanism are pneumatically operated.

12. The hospital bed of claim 1, and further comprising a stationary bed stand, said frame assembly being placeable upon the bed stand.

13. The hospital bed claim 1, and the further comprising a mobile bed stand, said frame assembly being placeable upon the bed stand.

14. The hospital bed of claim 1, and further comprising a lid secured to the frame assembly and adjustable in position relative to the toilet pan for sealingly closing the toilet pan.

* * * * *